US007429044B2

(12) United States Patent
O'Brien

(10) Patent No.: US 7,429,044 B2
(45) Date of Patent: Sep. 30, 2008

(54) SCRATCH-TICKET LOTTERY AND PROMOTIONAL GAMES

(75) Inventor: James M. O'Brien, Burlington, MA (US)

(73) Assignee: Scientific Games International, Inc., Newark, DE (US)

( * ) Notice: Subject to any disclaimer, the term of this patent is extended or adjusted under 35 U.S.C. 154(b) by 337 days.

(21) Appl. No.: 11/215,054

(22) Filed: Aug. 30, 2005

(65) Prior Publication Data

US 2006/0043670 A1 Mar. 2, 2006

Related U.S. Application Data

(60) Provisional application No. 60/605,908, filed on Aug. 31, 2004.

(51) Int. Cl.
*A63F 3/06* (2006.01)

(52) U.S. Cl. ..... 273/139; 283/901; 283/903

(58) Field of Classification Search ..... 273/139, 273/269; 283/901, 903
See application file for complete search history.

(56) References Cited

U.S. PATENT DOCUMENTS

| | | | |
|---|---|---|---|
| 1,527,929 | A | 2/1925 | Simons |
| 3,089,123 | A | 5/1963 | Hennis et al. |
| 3,245,697 | A | 4/1966 | BNugent |
| 3,699,311 | A | 10/1972 | Dunbar |
| 3,736,368 | A | 5/1973 | Vogelman et al. |
| 3,826,499 | A | 7/1974 | Lenkoff |
| 3,868,057 | A | 2/1975 | Chavez |
| 3,876,865 | A | 4/1975 | Bliss |
| 3,902,253 | A | 9/1975 | Sabuzawa et al. |
| 3,918,174 | A | 11/1975 | Miller et al. |
| 3,922,529 | A | 11/1975 | Orloff |
| 3,934,120 | A | 1/1976 | Maymarev |
| 4,017,834 | A | 4/1977 | Cuttill et al. |
| 4,095,824 | A | 6/1978 | Bachman |
| 4,105,156 | A | 8/1978 | Dethloff |
| 4,176,406 | A | 11/1979 | Matkan |
| 4,191,376 | A | 3/1980 | Goldman et al. |
| 4,194,296 | A | 3/1980 | Pagnozzi et al. |

(Continued)

FOREIGN PATENT DOCUMENTS

| | | |
|---|---|---|
| AU | B-18428/92 | 12/1992 |

(Continued)

OTHER PUBLICATIONS

Webcraft "Hold'em Poker", Webcraft Games, Inc., Received in the PTO on Jun. 4, 1999.*

(Continued)

*Primary Examiner*—Benjamin H Layno
(74) *Attorney, Agent, or Firm*—Dority & Manning, P.A.

(57) ABSTRACT

A scratch-ticket game card simulating a instant Texas Hold'Em Poker game card with multiple chances of winning for a player. The instant game card includes plurality sets of player hands and a set of opponent hands, a set of community cards, and at least two prizes. The player can combine the set of community cards with each set of player hands to form a strongest hand for that set of player hands. The strongest hand for each set of player hands is compared against the strongest hand for the opponent hand. If the player wins, the player wins the prize associated with the winning player hand.

7 Claims, 2 Drawing Sheets

U.S. PATENT DOCUMENTS

| | | | |
|---|---|---|---|
| 4,195,772 | A | 4/1980 | Nishimura |
| 4,206,920 | A | 6/1980 | Weatherford et al. |
| 4,241,942 | A | 12/1980 | Bachman |
| 4,243,216 | A | 1/1981 | Mazumder |
| 4,273,362 | A | 6/1981 | Carrier et al. |
| 4,309,452 | A | 1/1982 | Sachs |
| 4,313,087 | A | 1/1982 | Weitzen et al. |
| 4,355,300 | A | 10/1982 | Weber |
| 4,375,666 | A | 3/1983 | Buck et al. |
| 4,398,708 | A | 8/1983 | Goldman et al. |
| 4,407,443 | A | 10/1983 | McCorkle |
| 4,451,759 | A | 5/1984 | Heynisch |
| 4,455,039 | A | 6/1984 | Weitzen et al. |
| 4,457,430 | A | 7/1984 | Darling et al. |
| 4,464,423 | A | 8/1984 | LaBianca et al. |
| 4,466,614 | A | 8/1984 | Bachman et al. |
| 4,488,646 | A | 12/1984 | McCorkle |
| 4,491,319 | A | 1/1985 | Nelson |
| 4,494,197 | A | 1/1985 | Troy et al. |
| 4,536,218 | A | 8/1985 | Ganho |
| 4,544,184 | A | 10/1985 | Freund et al. |
| 4,579,371 | A | 4/1986 | Long et al. |
| 4,591,189 | A | 5/1986 | Holmen et al. |
| 4,634,149 | A | 1/1987 | Donovan |
| 4,665,502 | A | 5/1987 | Kreisner |
| 4,669,729 | A | 6/1987 | Solitt et al. |
| 4,689,742 | A | 8/1987 | Troy et al. |
| 4,726,608 | A | 2/1988 | Walton |
| 4,736,109 | A | 4/1988 | Dvorzsak |
| 4,740,016 | A | 4/1988 | Konecny et al. |
| 4,760,247 | A | 7/1988 | Keane et al. |
| 4,763,927 | A | 8/1988 | Schneider |
| 4,775,155 | A | 10/1988 | Lees |
| 4,792,667 | A | 12/1988 | Chen |
| 4,805,907 | A | 2/1989 | Hagiwara |
| 4,817,951 | A | 4/1989 | Crouch et al. |
| 4,835,624 | A | 5/1989 | Black et al. |
| 4,836,546 | A | 6/1989 | Dire et al. |
| 4,836,553 | A | 6/1989 | Suttle et al. |
| 4,837,728 | A | 6/1989 | Barrie et al. |
| 4,856,787 | A | 8/1989 | Itkis |
| 4,861,041 | A | 8/1989 | Jones et al. |
| 4,870,260 | A | 9/1989 | Niepolomski et al. |
| 4,880,964 | A | 11/1989 | Donahue |
| 4,888,964 | A | 12/1989 | Klinge |
| 4,922,522 | A | 5/1990 | Scanlon |
| 4,943,090 | A | 7/1990 | Fienberg |
| 4,960,611 | A | 10/1990 | Fujisawa et al. |
| 4,961,578 | A | 10/1990 | Chateau |
| 4,964,642 | A | 10/1990 | Kamille |
| 4,996,705 | A | 2/1991 | Entenmann et al. |
| 4,998,010 | A | 3/1991 | Chandler et al. |
| 4,998,199 | A | 3/1991 | Tashiro et al. |
| 5,032,708 | A | 7/1991 | Comerford et al. |
| 5,037,099 | A | 8/1991 | Burtch |
| 5,046,737 | A | 9/1991 | Fienberg |
| 5,074,566 | A | 12/1991 | Desbiens |
| 5,083,815 | A | 1/1992 | Scrymgeour et al. |
| 5,092,598 | A | 3/1992 | Kamille |
| 5,094,458 | A | 3/1992 | Kamille |
| 5,100,139 | A | 3/1992 | Di Bella |
| 5,109,153 | A | 4/1992 | Johnsen et al. |
| 5,112,050 | A | 5/1992 | Koza et al. |
| 5,116,049 | A | 5/1992 | Sludikoff et al. |
| 5,118,109 | A | 6/1992 | Gumina |
| 5,119,295 | A | 6/1992 | Kapur |
| 5,158,293 | A | 10/1992 | Mullins |
| 5,165,967 | A | 11/1992 | Theno et al. |
| 5,186,463 | A | 2/1993 | Marin et al. |
| 5,189,292 | A | 2/1993 | Batterman et al. |
| 5,193,815 | A | 3/1993 | Pollard |
| 5,193,854 | A | 3/1993 | Borowski, Jr. et al. |
| 5,228,692 | A | 7/1993 | Carrick et al. |
| 5,232,221 | A | 8/1993 | Sludikoff et al. |
| 5,234,798 | A | 8/1993 | Heninger et al. |
| 5,249,801 | A | 10/1993 | Jarvis |
| 5,259,616 | A | 11/1993 | Bergmann |
| 5,273,281 | A | 12/1993 | Lovell |
| 5,276,980 | A | 1/1994 | Carter et al. |
| 5,282,620 | A | 2/1994 | Keesee |
| 5,308,992 | A | 5/1994 | Crane et al. |
| 5,317,135 | A | 5/1994 | Finocchio |
| 5,326,104 | A | 7/1994 | Pease et al. |
| 5,332,219 | A | 7/1994 | Marnell, II et al. |
| 5,342,047 | A | 8/1994 | Heidel et al. |
| 5,342,049 | A | 8/1994 | Wichinsky et al. |
| 5,344,144 | A | 9/1994 | Canon |
| 5,346,258 | A | 9/1994 | Behm et al. |
| 5,380,007 | A | 1/1995 | Travis et al. |
| 5,393,057 | A | 2/1995 | Marnell, II |
| 5,401,024 | A | 3/1995 | Simunek |
| 5,401,541 | A | 3/1995 | Hodnett, III |
| 5,403,039 | A | 4/1995 | Borowski, Jr. et al. |
| 5,407,199 | A | 4/1995 | Gumina |
| 5,420,406 | A | 5/1995 | Izawa et al. |
| 5,432,005 | A | 7/1995 | Tanigami et al. |
| 5,451,052 | A | 9/1995 | Behm et al. |
| 5,453,602 | A | 9/1995 | Hanada |
| 5,456,465 | A | 10/1995 | Durham |
| 5,471,039 | A | 11/1995 | Irwin, Jr. et al. |
| 5,471,040 | A | 11/1995 | May |
| 5,475,205 | A | 12/1995 | Behm et al. |
| 5,486,005 | A | 1/1996 | Neal |
| 5,513,846 | A | 5/1996 | Niederlein et al. |
| 5,528,154 | A | 6/1996 | Leichner et al. |
| 5,536,016 | A | 7/1996 | Thompson |
| 5,540,442 | A | 7/1996 | Orselli et al. |
| 5,548,110 | A | 8/1996 | Storch et al. |
| 5,550,746 | A | 8/1996 | Jacobs |
| 5,560,610 | A | 10/1996 | Behm et al. |
| 5,564,700 | A | 10/1996 | Celona |
| 5,564,977 | A | 10/1996 | Algie |
| 5,591,956 | A | 1/1997 | Longacre, Jr. et al. |
| 5,599,046 | A | 2/1997 | Behm et al. |
| 5,602,381 | A | 2/1997 | Hoshino et al. |
| 5,621,200 | A | 4/1997 | Irwin et al. |
| 5,628,684 | A | 5/1997 | Bouedec |
| 5,630,753 | A | 5/1997 | Fuchs |
| 5,651,735 | A | 7/1997 | Baba |
| 5,655,961 | A | 8/1997 | Acres et al. |
| 5,667,250 | A | 9/1997 | Behm et al. |
| 5,682,819 | A | 11/1997 | Beatty |
| 5,690,366 | A | 11/1997 | Luciano |
| 5,704,647 | A | 1/1998 | Desbiens |
| 5,722,891 | A | 3/1998 | Inoue |
| 5,726,898 | A | 3/1998 | Jacobs |
| 5,732,948 | A | 3/1998 | Yoseloff |
| 5,741,183 | A | 4/1998 | Acres et al. |
| 5,743,800 | A | 4/1998 | Huard et al. |
| 5,752,882 | A | 5/1998 | Acres et al. |
| 5,756,220 | A | 5/1998 | Hoshino et al. |
| 5,768,142 | A | 6/1998 | Jacobs |
| 5,769,458 | A | 6/1998 | Carides et al. |
| 5,770,533 | A | 6/1998 | Franchi |
| 5,772,509 | A | 6/1998 | Weiss |
| 5,772,510 | A | 6/1998 | Roberts |
| 5,772,511 | A | 6/1998 | Smeltzer |
| RE35,864 | E | 7/1998 | Weingardt |
| 5,779,840 | A | 7/1998 | Boris |
| 5,789,459 | A | 8/1998 | Inagaki et al. |
| 5,791,990 | A | 8/1998 | Schroeder et al. |
| 5,797,794 | A | 8/1998 | Angell |
| 5,803,504 | A | 9/1998 | Deshiens et al. |
| 5,816,920 | A | 10/1998 | Hanai |

| | | | |
|---|---|---|---|
| 5,818,019 | A | 10/1998 | Irwin, Jr. et al. |
| 5,820,459 | A | 10/1998 | Acres et al. |
| 5,823,874 | A | 10/1998 | Adams |
| 5,830,063 | A | 11/1998 | Byrne |
| 5,830,066 | A | 11/1998 | Goden et al. |
| 5,830,067 | A | 11/1998 | Graves et al. |
| 5,833,537 | A | 11/1998 | Barrie |
| 5,835,576 | A | 11/1998 | Katz et al. |
| 5,836,086 | A | 11/1998 | Elder |
| 5,836,817 | A | 11/1998 | Acres et al. |
| 5,848,932 | A | 12/1998 | Adams |
| 5,863,075 | A | 1/1999 | Rich et al. |
| 5,871,398 | A | 2/1999 | Schneier et al. |
| 5,876,284 | A | 3/1999 | Acres et al. |
| 5,882,261 | A | 3/1999 | Adams |
| 5,883,537 | A | 3/1999 | Luoni et al. |
| 5,885,158 | A | 3/1999 | Torango et al. |
| 5,887,906 | A | 3/1999 | Sultan |
| 5,903,340 | A | 5/1999 | Lawady et al. |
| 5,911,418 | A | 6/1999 | Adams |
| 5,915,588 | A | 6/1999 | Stoken et al. |
| 5,934,671 | A | 8/1999 | Harrison |
| 5,970,143 | A | 10/1999 | Schneier et al. |
| 5,979,894 | A | 11/1999 | Alexoff |
| 5,996,997 | A | 12/1999 | Kamille |
| 5,997,044 | A | 12/1999 | Behm et al. |
| 6,004,207 | A | 12/1999 | Wilson, Jr. et al. |
| 6,004,208 | A | 12/1999 | Takemoto et al. |
| 6,007,162 | A | 12/1999 | Hinz et al. |
| 6,012,982 | A | 1/2000 | Piechowiak et al. |
| 6,014,032 | A | 1/2000 | Maddix et al. |
| 6,017,032 | A | 1/2000 | Grippo et al. |
| 6,024,641 | A | 2/2000 | Sarno |
| 6,033,307 | A | 3/2000 | Vancura |
| 6,053,405 | A | 4/2000 | Irwin, Jr. et al. |
| 6,077,162 | A | 6/2000 | Weiss |
| 6,080,062 | A | 6/2000 | Olson |
| 6,086,477 | A | 7/2000 | Walker et al. |
| 6,089,978 | A | 7/2000 | Adams |
| 6,099,407 | A | 8/2000 | Parker, Jr. et al. |
| 6,102,400 | A | 8/2000 | Scott et al. |
| 6,107,913 | A | 8/2000 | Gatto et al. |
| 6,119,364 | A | 9/2000 | Elder |
| 6,125,368 | A | 9/2000 | Bridge et al. |
| 6,142,872 | A | 11/2000 | Walker et al. |
| 6,146,272 | A | 11/2000 | Walker et al. |
| 6,149,521 | A | 11/2000 | Sanduski |
| 6,155,491 | A | 12/2000 | Dueker et al. |
| 6,168,521 | B1 | 1/2001 | Luciano et al. |
| 6,168,522 | B1 | 1/2001 | Walker et al. |
| 6,179,710 | B1 | 1/2001 | Sawyer et al. |
| 6,203,430 | B1 | 3/2001 | Walker et al. |
| 6,206,373 | B1 | 3/2001 | Garrod |
| 6,210,275 | B1 | 4/2001 | Olsen |
| 6,217,448 | B1 | 4/2001 | Olsen |
| 6,220,961 | B1 | 4/2001 | Keane et al. |
| 6,224,055 | B1 | 5/2001 | Walker et al. |
| 6,227,969 | B1 | 5/2001 | Yoseloff |
| 6,238,288 | B1 | 5/2001 | Walker et al. |
| 6,309,300 | B1 | 10/2001 | Glavich |
| 6,312,334 | B1 | 11/2001 | Yoseloff |
| 6,315,291 | B1 | 11/2001 | Moody |
| 6,330,976 | B1 | 12/2001 | Dymetman et al. |
| 6,331,143 | B1 | 12/2001 | Yoseloff |
| 6,334,814 | B1 | 1/2002 | Adams |
| 6,340,158 | B2 | 1/2002 | Pierce et al. |
| 6,368,213 | B1 | 4/2002 | McNabola |
| 6,375,568 | B1 | 4/2002 | Roffman et al. |
| 6,379,742 | B1 | 4/2002 | Behm et al. |
| 6,394,899 | B1 | 5/2002 | Walker et al. |
| 6,398,214 | B1 | 6/2002 | Moteki et al. |
| 6,398,643 | B1 | 6/2002 | Knowles et al. |
| 6,398,644 | B1 | 6/2002 | Perrie et al. |
| 6,398,645 | B1 | 6/2002 | Yoseloff |
| 6,416,408 | B2 | 7/2002 | Tracy et al. |
| 6,419,579 | B1 | 7/2002 | Bennett |
| 6,435,408 | B1 | 8/2002 | Irwin, Jr. et al. |
| 6,435,500 | B2 | 8/2002 | Gumina |
| 6,478,677 | B1 | 11/2002 | Moody |
| 6,491,215 | B1 | 12/2002 | Irwin, Jr. et al. |
| 6,497,408 | B1 | 12/2002 | Walker et al. |
| 6,552,290 | B1 | 4/2003 | Lawandy |
| 6,588,747 | B1 | 7/2003 | Seelig |
| 6,599,186 | B1 | 7/2003 | Walker et al. |
| 6,601,772 | B1 | 8/2003 | Rubin et al. |
| 6,637,747 | B1 | 10/2003 | Garrod |
| 6,648,735 | B2 | 11/2003 | Miyashita et al. |
| 6,648,753 | B1 | 11/2003 | Tracy et al. |
| 6,648,755 | B1 | 11/2003 | Luciano et al. |
| 6,676,126 | B1 | 1/2004 | Walker et al. |
| 6,692,354 | B2 | 2/2004 | Tracy et al. |
| 6,702,047 | B2 | 3/2004 | Huber |
| 6,773,345 | B2 | 8/2004 | Walker et al. |
| 6,776,337 | B2 | 8/2004 | Irwin, Jr. et al. |
| 6,786,824 | B2 | 9/2004 | Cannon |
| 6,823,874 | B2 | 11/2004 | Lexcen |
| 6,875,105 | B1 | 4/2005 | Behm et al. |
| 6,929,186 | B2 | 8/2005 | Lapstun |
| 2001/0027130 | A1 | 10/2001 | Namba et al. |
| 2001/0030978 | A1 | 10/2001 | Holloway et al. |
| 2001/0034262 | A1 | 10/2001 | Banyai |
| 2001/0040345 | A1 | 11/2001 | Au-Yeung |
| 2002/0022511 | A1 | 2/2002 | Eklund et al. |
| 2002/0084335 | A1 | 7/2002 | Ericson |
| 2002/0171201 | A1 | 11/2002 | Au-Yeung |
| 2002/0187825 | A1 | 12/2002 | Tracy et al. |
| 2003/0050109 | A1 | 3/2003 | Caro et al. |
| 2003/0114210 | A1 | 6/2003 | Meyer et al. |
| 2004/0076310 | A1 | 4/2004 | Hersch et al. |
| 2004/0173965 | A1 | 9/2004 | Stanek |
| 2004/0178582 | A1 | 9/2004 | Garrod |
| 2004/0185931 | A1 | 9/2004 | Hartman et al. |
| 2004/0204222 | A1 | 10/2004 | Roberts |
| 2004/0259631 | A1 | 12/2004 | Katz et al. |
| 2004/0266514 | A1 | 12/2004 | Penrice |

FOREIGN PATENT DOCUMENTS

| | | | |
|---|---|---|---|
| AU | B-21070/92 | | 7/1993 |
| AU | A-50327/96 | | 2/1997 |
| AU | B-52499/96 | | 2/1997 |
| AU | 199716432 | B2 | 9/1997 |
| AU | A-45403/97 | | 4/1998 |
| AU | A-63553/98 | | 10/1998 |
| DE | 2938307 | C2 | 4/1981 |
| DE | 3035898 | A1 | 4/1982 |
| DE | 3035947 | A1 | 5/1982 |
| DE | 2938307 | C3 | 6/1982 |
| DE | 29803107 | U1 | 8/1988 |
| DE | 3822636 | A1 | 1/1990 |
| DE | 2938307 | C3 | 8/1990 |
| DE | 3822636 | A1 | 1/1992 |
| DE | 3415114 | A1 | 10/1995 |
| DE | 19646956 | C1 | 5/1998 |
| DE | 19706286 | A1 | 5/1998 |
| DE | 29816453 | U1 | 4/1999 |
| DE | 195751746 | A1 | 5/1999 |
| EP | 0122902 | B1 | 4/1984 |
| EP | 0333934 | A1 | 9/1989 |
| EP | 0458623 | | 11/1991 |
| EP | 0798676 | A1 | 10/1997 |
| EP | 0799649 | A1 | 10/1997 |
| EP | 0149712 | A2 | 7/1998 |
| EP | 0874337 | A1 | 10/1998 |
| EP | 0896304 | A2 | 2/1999 |
| EP | 0914875 | A2 | 5/1999 |

| | | | |
|---|---|---|---|
| EP | 0914875 | A3 | 5/1999 |
| EP | 0919965 | A2 | 6/1999 |
| EP | 0983801 | A2 | 3/2000 |
| EP | 0983801 | A3 | 3/2001 |
| EP | 1149712 | A1 | 10/2001 |
| ES | 529535 | | 6/1983 |
| ES | 529536 | | 6/1983 |
| ES | 2006400 | | 4/1989 |
| ES | 2006401 | | 4/1989 |
| GB | 642892 | A | 9/1950 |
| GB | 2075918 | A | 11/1981 |
| GB | 2222712 | B | 3/1990 |
| GB | 2230373 | A | 10/1990 |
| GB | 2295775 | A | 12/1996 |
| GB | 3328311 | | 2/1999 |
| GB | 23282311 | A | 2/1999 |
| JP | 02235744 | | 9/1990 |
| JP | 04132672 | | 5/1992 |
| WO | WO85/02250 | A1 | 5/1985 |
| WO | WO91/17529 | | 11/1991 |
| WO | WO 98/03910 | | 1/1998 |
| WO | WO 98/40138 | | 9/1998 |
| WO | WO 99/09364 | A1 | 2/1999 |
| WO | WO 99/26204 | | 5/1999 |
| WO | WO 99/39312 | | 8/1999 |
| WO | WO00/00256 | | 1/2000 |
| WO | WO00/78418 | A1 | 12/2000 |
| WO | WO01/74460 | A2 | 11/2001 |
| WO | WO01/93966 | A1 | 12/2001 |
| WO | WO02/056266 | A1 | 7/2002 |

OTHER PUBLICATIONS

'Are You In?', (Article).

'Beginner's Guide-How To Bet', (www.plimico.com/How+to+wager/beginnersguide/), (Internet Article), 3 Pgs.

Chip Brown, 'Austin American-Statesman', (Article), May 28, 1998, 2 Pgs., Texas.

John C. Hallyburton, Jr., 'Frequently Asked Questions About Keno', (Internet Article),1995, 1998, 10 Pgs., (http://conielco.com/faq/keno.html).

'Horse betting Tutorial-Types of Bets' (www.homepokergames.com/horsebettingtutorial.php), (Internet Article), 2 Pgs.

Judith Gaines, 'Pool Party Betting Business Booming Throughout Area Workplaces', (Internet Article), Mar. 19, 1994, 2 Pgs., Issue 07431791, Boston Globe, Boston, MA.

'Maryland Launches Let It Ride', (Internet Article), Circa 2001,1 Pg.

'Notice of Final Rulemaking', (Internet Article) Mar. 24, 2000, 10 Pgs., vol. 6, Issue #13, Arizona Administrative Register, Arizona.

'How To Play Megabucks', (Internet Article), Mar. 9, 2001, 2 Pgs., Oregon Lottery Megabucks,(http://www.oregonlottery.org/mega/m_howto.htm).

'How To Play Megabucks', (Internet Article), May 8, 2001, 2 Pgs., Oregon Lottery Megabucks, (http://www.oregonlottery.org/mega/m_howto.htm).

'Oregon Lottery', (Internet Article), Apr. 30, 2004, 9 Pgs., Oregon Lottery Web Center, (http://www.oregonlottery.org/general/g_hist.shtml).

'Powerball Odd & Prizes', 'How to Play Powerball', (Internet Article), Dec. 2002, 2 Pgs., (www.powerball.com/pbhowtoplay.shtm).

'Powerball Prizes and Odds', (Internet Article), 2 Pgs., http://www.powerball.com/pbprizesNOdds.shtm.

'Learn To Play the Races' (Internet Article), 15 Pgs., Racing Daily Form (www.drf.com).

Mike Parker, 'The History of Horse Racing' (Internet Article), 1996, 1997, 1998, 5 Pgs., http://www.mrmike.com/explore/hrhist.htm.

* cited by examiner

SCRATCH-TICKET LOTTERY AND PROMOTIONAL GAMES

CROSS REFERENCES TO RELATED APPLICATIONS

This application claims the benefit of U.S. Provisional Patent Application Ser. No. 60/605,908, Scratch Ticket Lottery and Promotional Games, filed on Aug. 31, 2004, the entire specification of which is incorporated herein by this reference.

BACKGROUND OF THE INVENTION

1. Field of the Invention

The present invention generally relates to game of chance and, more specifically, to a scratch ticket instant lottery game that generally simulates the playing of a Texas Hold'Em Poker card game.

2. Description of the Related Art

Lottery games and instant games, whether run by governmental or private entities, have proven to be quite popular, and go back some time in history. Participation in a game gives a person a chance to win a cash or a merchandise prize while also allowing private parties and lottery authorities to collect monies for public or charitable purposes. When taxed, the sales from games also provide additional revenue to state and city governments.

Instant lottery games are generally based on revealing predetermined game symbols, the games having a pre-determined outcome based on the programmed game parameters. While these games are generally profitable, they are not always very interesting to play. In order for a new lottery game to attract players, different themes have been developed for instant win lottery games. One of the examples of a game with a card game theme is Texas Hold'Em poker game as disclosed by the U.S. Pat. Nos. 5,407,199 and 6,435,500 B2. However, the games disclosed by these patents are mostly interactive games in which a set of three hands are displayed to a player, who will then choose one of the hands to play. After choosing one hand to play, a corresponding set of community cards is revealed. If the player has chosen the set of community cards that provides him with the highest possible choice, the player wins the corresponding prize. In the prior art game, the player does not play against an opponent and the chance of winning is one out of three.

Accordingly, it is desirous to have an instant win Texas Hold'Em styled poker lottery game that is easy to play, and which presents some challenge to the player. Such game could additionally provide the player more chances to win than a standard scratch-off lottery game. It is thus to such a game that the present invention is primarily directed.

SUMMARY OF THE INVENTION

In one embodiment, the invention is a method for making a scratch-off instant game card. The method includes placing a set of community game elements on a game card, placing at least two sets of player game elements on the game card, and placing a set of opponent game elements on the game card. The set of community game elements includes five game elements, each set of player game elements includes two game elements, and the set of opponent game elements includes two game elements. The method also includes covering the set of community game elements, the at least two sets of player game elements, and the set of opponent game elements.

In another embodiment, the invention is a scratch-off instant game card. The scratch-off instant game card includes a set of community game elements, at least two sets of player game elements, and a set of opponent game elements. The set of community game elements includes five game elements, each set of player game elements includes two game elements, and the set of opponent game elements includes two game elements.

In yet another embodiment, the invention is a method for playing an instant lottery game. The method includes the steps of displaying a set of community game elements to a player, displaying a plurality of sets of player game elements to the player, displaying a set of opponent game elements to the player, determining a highest player winning set for each of the plurality of sets of player game elements according to a predefined rule, determining a highest opponent winning set for the set of opponent game elements according to the predefined rule, comparing the highest player winning set for each of the plurality of sets of player game elements with the highest opponent winning set, if the highest player winning set for at least one set of player game elements wins over the highest opponent winning set, determining a prize for the player. The set of community game elements includes five game elements, each set of player game elements includes two game elements, and the set of opponent game elements includes two game elements.

Other aspects and features of the invention will become apparent after review of the hereinafter set forth in the following Brief Description of the Drawings, Detailed Description of the Invention, and the Claims.

DETAILED DESCRIPTION OF THE INVENTION

Figure 1:
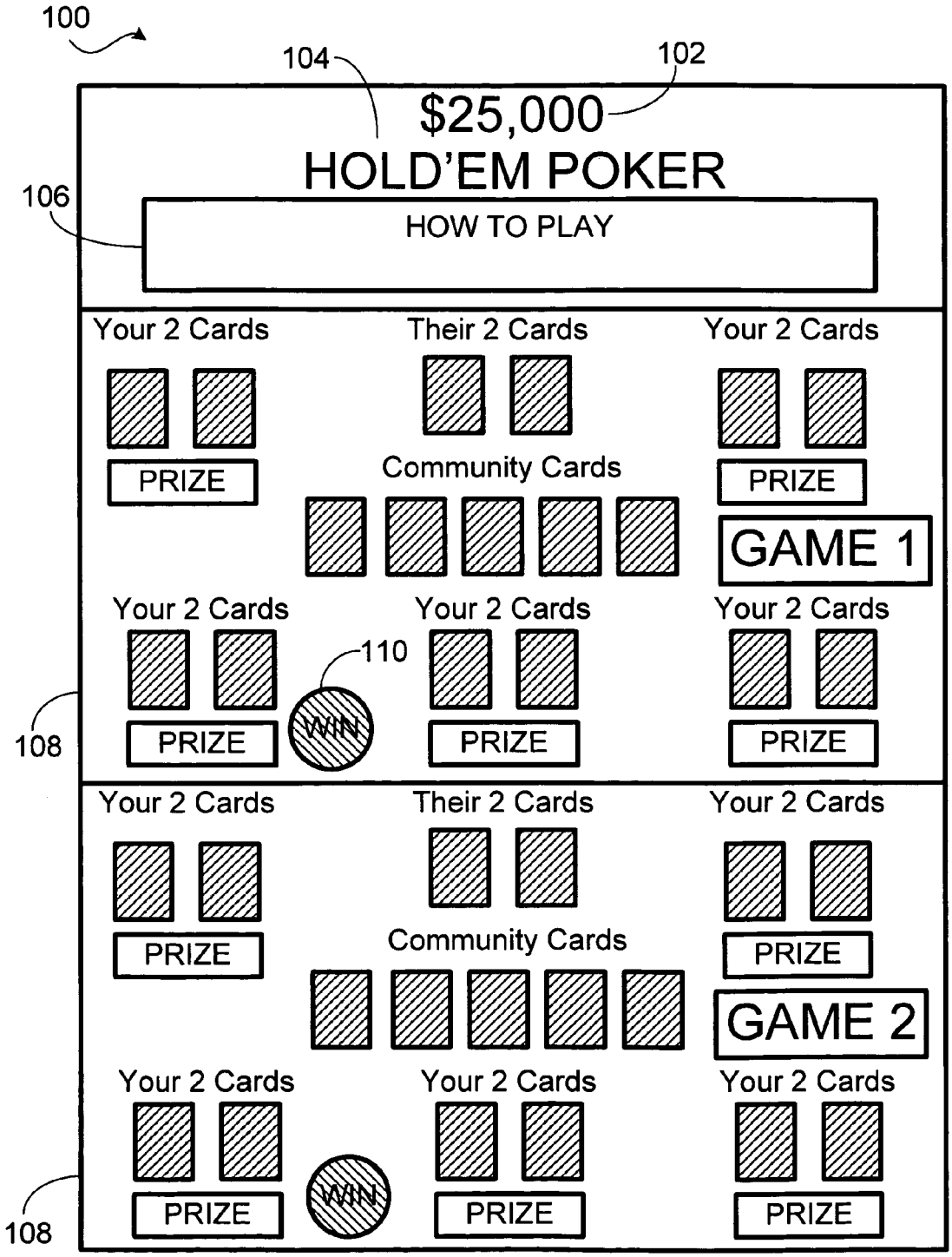
FIG. 1 illustrates one embodiment of an instant game ticket according to the invention.

The rules for the playing card game of Texas Hold'Em Poker game are as follows. A player makes his or her best poker hand out of seven cards (game elements), with two cards in the player's hand and the five other community cards. Thus, all players in the game use three or more of the community cards to make their best poker hands. The player with the strongest hand wins. In play with playing cards, the game starts with the dealer dealing two cards face down to each player, and a round of betting commences. After all bets, raises, and folds are completed, the first three community cards are dealt. The first three community cards are turned up all at once and are called "the flop." The flop is often the turning point in the game, determining who will remain in the game to see the last two cards. A round of betting occurs immediately after the flop. Most players fold their hand if the flop does not fit well with their game hand. The fourth community cards is called "the turn." As in previous plays, bets are placed. Finally, the fifth and final community card is turned over. This card is commonly called "the river." The last round of betting is complete then the players turn over their cards, and the player with the highest hand wins.

This invention is directed to the implementation of a Texas Hold'Em styled poker instant lottery game, preferably on a scratch-off ticket. Because of the limitations of an instant game, the rules of the known styles of Texas Hold'Em poker games need to be altered for use as a predetermined lottery game card or ticket. In one embodiment of the invention, six sets of game cards and five community cards are printed for one game, where each set of game cards consisting of two cards and being associated with one prize. The community cards, six sets of games cards and associated prizes are all initially covered by a removable elastomeric material, commonly referred to by those skilled in the art as "latex," which material may be removed in any order by being rubbed or "scratched" off to reveal the underlying game indicia. Moreover, the imaged game indicia, once covered by the latex, may then have additional graphic images printed thereover, as known in the art. The instant game cards may also be manufactured with anti-counterfeiting features, such as the use of Benday patterns and other features known in the art. A player who purchases a ticket of Texas Hold'Em poker instant game plays five sets (hands) of game cards against an imaginary opponent who plays one set of game cards.

After all community cards, six sets of games cards of one Texas Hold'Em poker instant game are uncovered, the strongest hand for each player's set is compared with the strongest hand for the opponent and the player wins if any strongest hand from one of his five sets beats the opponent's strongest hand. If any set of game cards wins over the opponent's game card, the player wins the prize associated with that set of game cards. If more than one set of game cards win, the player wins the prize associated with each winning set. Therefore, the user will have five times as many chances of winning.

FIG. 1 shows an instant Texas Hold'Em Poker game card 100 according to one embodiment of the invention. In game card 100, there are shown two instant games 108, where each instant game has five sets of player game cards (labeled as "your 2 cards), two opponent game cards (labeled as "their 2 cards"), five community cards, and five prize indicia, each prize indicia being associated with one set of player game cards. When a player buys one instant game card 100, he is entitled to play both instant games. Each game is played independently from other game; therefore, the player has two chances to win. Those skilled in the art would appreciate the number of instant games per an instant game card may vary from one implementation to another implementation. The instant game card 100 may also include other information such as the grand prize 102, the name of the game 104, game instructions 106, and a winning indicator 110. Though only one winning indicator 110 per game is shown in FIG. 1, those skilled in the art will appreciate multiple winning indicators, one per set of player game cards, may be employed. The prize indicia of each instant game may vary depending on the possibility of each winning hand. For example, the prize for a royal flush may be the grand prize 102 itself, and smaller prizes may be assigned for other winning hands.

Figure 2:
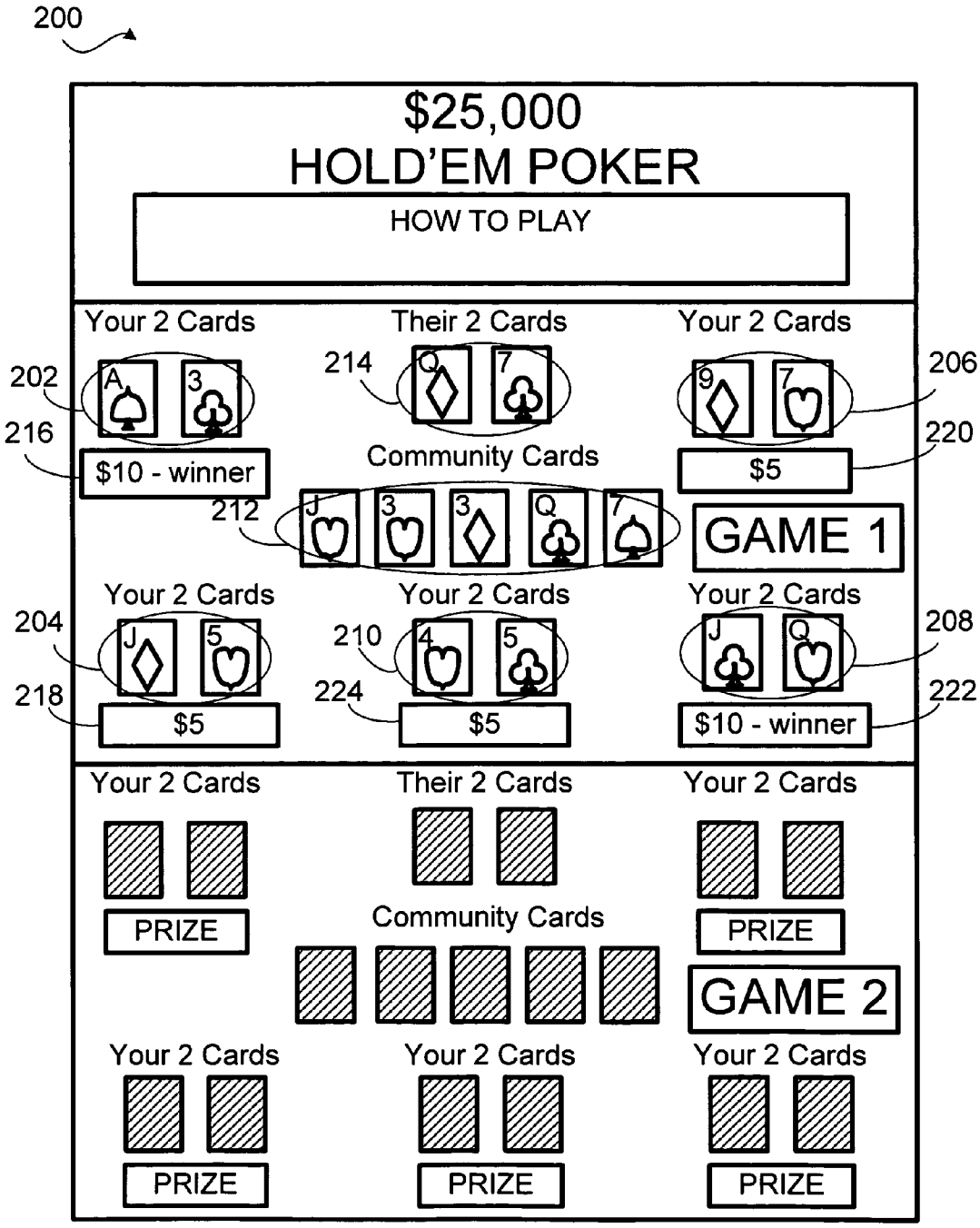
FIG. 2 illustrates one instant game ticket with game elements scratched off.

FIG. 2 illustrates one game in an alternative embodiment with all game elements uncovered. The player has five sets of hand 202, 204, 206, 208, 210, and the opponent has one set of hands 214. There are also one set of community cards 212 and five prizes 216, 218, 220, 222, 224. In this example, five player hands are formed in the following way:

First hand: combining the player hand 202 with three game cards selected from the community cards 212 that forms the highest ranking poker hand from this combination, which is triple threes—C3, H3, D3, X, X, where D represents diamond, C represents club, H represents heart, and X represents any of remaining community or player cards.

Second hand: combining the player hand 204 with three game cards selected from the community cards 212 that forms the highest ranking poker hand from this combination, which is two pairs (a pair of jacks and a pair of threes)—DJ, HJ, H3, D3, X.

Third hand: combining the player hand 206 with three game cards selected from the community cards 212 that forms the highest ranking poker hand from this combination, which is two pairs (a pair of sevens and a pair of threes)—H7, S7, H3, D3, X, where S represents spade.

Fourth hand: combining the player hand 208 with three game cards selected from the community cards 212 that forms the highest ranking poker hand from this combination, which is two pairs (a pair of queens and a pair of jacks)—HQ, CQ, HJ, CJ, X.

Fifth hand: combining the player hand 210 with three game cards selected from the community cards 212 that forms the highest ranking poker hand from this combination, which is a pair of threes—H3, D3, X, X, X.

The opponent's hand in FIG. 2 is formed in the following way:

Opponent's hand: combining the opponent hand 214 with three game cards selected from the community cards 212 that forms the strongest hand from this combination, which is two pairs (a pair of queens and a pair of sevens)—DQ, CQ, S7, C7, X.

In the example illustrated in FIG. 2, the strongest player hand for the sets 202 and 208 beats the opponent's strongest hand, and the player wins these two sets. The other three player sets, 204, 206, 208, do not beat the opponent's two pairs, and the player does not win these three sets. Because the player wins sets 202 and 208, the player is entitled to the prizes 216, 222 associated with these sets. The winning indicator is embedded in the prize boxes, as shown in the prizes 216 and 222. As it is shown, the player wins twice with one game and wins the combined prize of $20. When a single game card incorporates two games as shown in FIGS. 1 and 2, the winner will have ten chances of winning. Those of ordinary skill in the, art will recognize that the prize associated with each set of player hands can be varied by according to the probability distributions of the initial hands and the sets of community cards, and the mathematical expectation of the total prize payout. Those skilled in the art will also appreciate that number of hands that a player may play against an opponent may vary from what is shown in the exemplary embodiment illustrated in FIGS. 1 and 2.

While the invention has been particularly shown and described with reference to one embodiment thereof, it will be understood by those skilled in the art that various changes in form and detail may be made without departing from the spirit and scope of the present invention as set forth in the following claims. Furthermore, although elements of the invention may be described or claimed in the singular, the plural is contemplated unless limitation to the singular is explicitly stated.

What is claimed is:

1. A method for making a scratch-off instant game card, comprising the steps of:

placing a set of community game elements on a game card, the set of community game elements including at least five game elements;

placing at least a first set and a second set of player game elements on the game card, each set of player game elements including at least two game elements;

placing a set of opponent game elements on the game card, the set of opponent game elements including at least two game elements;

covering with a removable covering the set of community game elements, the first and second sets of player game elements, and the set of opponent game elements; and placing at least two prize elements on the game card and associated prize instructions, wherein each prize element is associated with one of the first and second set of player game elements and the prize instructions direct that if a highest player winning set from made from the set of community game elements and each of the first set and second set of player game elements according to defined game rules wins over the highest opponent winning set, the prize for the player is a combination of the prizes associated with each of the first and second sets of player game elements.

2. A scratch-off instant game card, comprising:

a set of community game elements, the set of community game elements including five game elements;

at least a first set and a second set of player game elements, each set of player game elements including two game elements; and a set of opponent game elements, the set of opponent game elements including two game elements; and at least two prize elements on the game card and associated prize instructions, wherein each prize element is associated with one of the first and second set of player game elements and the prize instructions direct that if a highest player winning set from made from the set of community game elements and each of the first set and second set of player game elements according to defined game rules wins over the highest opponent winning set, the prize for the player is a combination of the prizes associated with each of the first and second sets of player game elements.

3. The scratch-off instant game card of claim 2, wherein the set of community game elements, the at least first and second of player game elements, and the set of opponent game elements are covered with a removable covering.

4. A method for playing an instant lottery game, comprising the steps of:

displaying a set of community game elements to a player, the set of community game elements including five game elements;

displaying a plurality of sets of player game elements to the player, each set of player game elements including two game elements;

displaying a set of opponent game elements to the player, the set of opponent game elements including two game elements;

displaying a plurality of prize elements, each prize element is associated with one of the plurality of sets of player game elements;

determining a highest player winning set for each of the plurality of sets of player game elements according to a predefined rule;

determining a highest opponent winning set for the set of opponent game elements according to the predefined rule;

comparing the highest player winning set for each of the plurality of sets of player game elements with the highest opponent winning set;

if the highest player winning set for at least one set of player game elements wins over the highest opponent winning set, awarding the prize for the respective set of player game elements to the player; and if more than one highest player winning set wins over the highest opponent winning set, awarding a prize for the player by combining the prizes for the respective sets of player game elements.

5. The method of claim 4, wherein the step of determining a highest player winning set for each of the plurality of sets of player game elements further comprising the step of combining each of the plurality of sets of player game elements with three game elements selected from the set of community game elements.

6. The method of claim 4, wherein the predefined rule is the rule for a Texas Hold'Em Poker game.

7. The method of claim 4, further comprising steps of:

covering the set of community game elements with a removable covering prior to the step of displaying the set of community game elements to a player;

covering the plurality sets of player game elements with a removable covering prior to the step of displaying the plurality sets of player game elements to the player; and covering the set of opponent game elements with a removable covering prior to the step of displaying the set of opponent game elements to the player.

* * * * *